US009552944B2

(12) United States Patent
Baujan et al.

(10) Patent No.: US 9,552,944 B2
(45) Date of Patent: Jan. 24, 2017

(54) SWITCHING DEVICE FOR DIRECT CURRENT APPLICATIONS

(71) Applicants: Guenther Baujan, Troisdorf (DE); Klaus Dauer, Koblenz (DE)

(72) Inventors: Guenther Baujan, Troisdorf (DE); Klaus Dauer, Koblenz (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 207 days.

(21) Appl. No.: 14/360,954

(22) PCT Filed: Oct. 29, 2012

(86) PCT No.: PCT/EP2012/071410
§ 371 (c)(1),
(2) Date: May 28, 2014

(87) PCT Pub. No.: WO2013/079269
PCT Pub. Date: Jun. 6, 2013

(65) Prior Publication Data

US 2014/0319099 A1 Oct. 30, 2014

(30) Foreign Application Priority Data

Nov. 29, 2011 (EP) ..... 11191219

(51) Int. Cl.
*H01H 33/18* (2006.01)
*H01H 1/20* (2006.01)
(Continued)

(52) U.S. Cl.
CPC ..... *H01H 33/182* (2013.01); *H01H 1/2025* (2013.01); *H01H 9/34* (2013.01);
(Continued)

(58) Field of Classification Search
CPC ..... H01H 33/08; H01H 50/38; H01H 9/44; H01H 9/443; H01H 50/546; H01H 1/20; H01H 50/02; H01H 50/54; H01H 2050/025; H01H 33/18; H01H 33/182; H01H 33/6642; H01H 1/2041; H01H 2050/028; H01H 33/12; H01H 33/20
(Continued)

(56) References Cited

U.S. PATENT DOCUMENTS 2,332,446 A 10/1943 Konrad
6,480,082 B1 * 11/2002 Aihara ..... H01H 1/2058 200/295

(Continued)

FOREIGN PATENT DOCUMENTS

DE 1246851 B 8/1967
DE 3409564 A1 9/1984
EP 2061053 A2 5/2009

*Primary Examiner* — Truc Nguyen
(74) *Attorney, Agent, or Firm* — Leydig, Voit & Mayer, Ltd.

(57) ABSTRACT

A switching device for direct current applications having a first switching chamber for a first current path and a second switching chamber for a second current path, each current path having a switching contact arrangement having a first and second contact, wherein both the contacts, switched-on, come into contact with each other and, switched-off, are kept out of contact with each other by the creation of an isolation gap; a current path having an extinguishing device to extinguish an arc created between the contacts; an arc driver arrangement, arranged in one of the two switching chambers, and which creates a magnetic field at least in the area of the switching contact arrangement for the relevant current path that drives the arc into the relevant extinguishing device.

14 Claims, 1 Drawing Sheet

(51) Int. Cl.
*H01H 9/34* (2006.01)
*H01H 9/44* (2006.01)
*H01H 33/08* (2006.01)
*H01H 33/59* (2006.01)

(52) U.S. Cl.
CPC ..... *H01H 9/443* (2013.01); *H01H 33/08* (2013.01); *H01H 33/596* (2013.01)

(58) Field of Classification Search
USPC .. 218/15, 22–26, 34–42, 149, 156; 335/201, 335/202
See application file for complete search history.

(56) References Cited

U.S. PATENT DOCUMENTS 7,541,902 B2 * 6/2009 Domejean ..... H01H 9/346 218/23
8,222,983 B2 * 7/2012 Zhou ..... H01H 9/443 218/150
8,742,278 B2 * 6/2014 Domejean ..... H01H 9/40 218/149
8,901,445 B2 * 12/2014 Tachikawa ..... H01H 9/40 218/26
9,006,601 B2 * 4/2015 Zhou ..... H01H 33/08 218/148
2002/0050890 A1 * 5/2002 Gula ..... H01H 71/08 335/202
2004/0227598 A1 * 11/2004 Ciarcia ..... H01H 1/2058 335/8
2004/0239458 A1 * 12/2004 Harmon ..... H01H 77/02 335/174
2009/0002106 A1 * 1/2009 Harmon ..... H01H 9/342 335/202
2009/0127229 A1 5/2009 Schmitz et al.
2011/0193664 A1 * 8/2011 Fisher ..... H01H 9/443 335/207
2014/0360985 A1 * 12/2014 Takaya ..... H01H 50/02 218/156

* cited by examiner

FIG.1
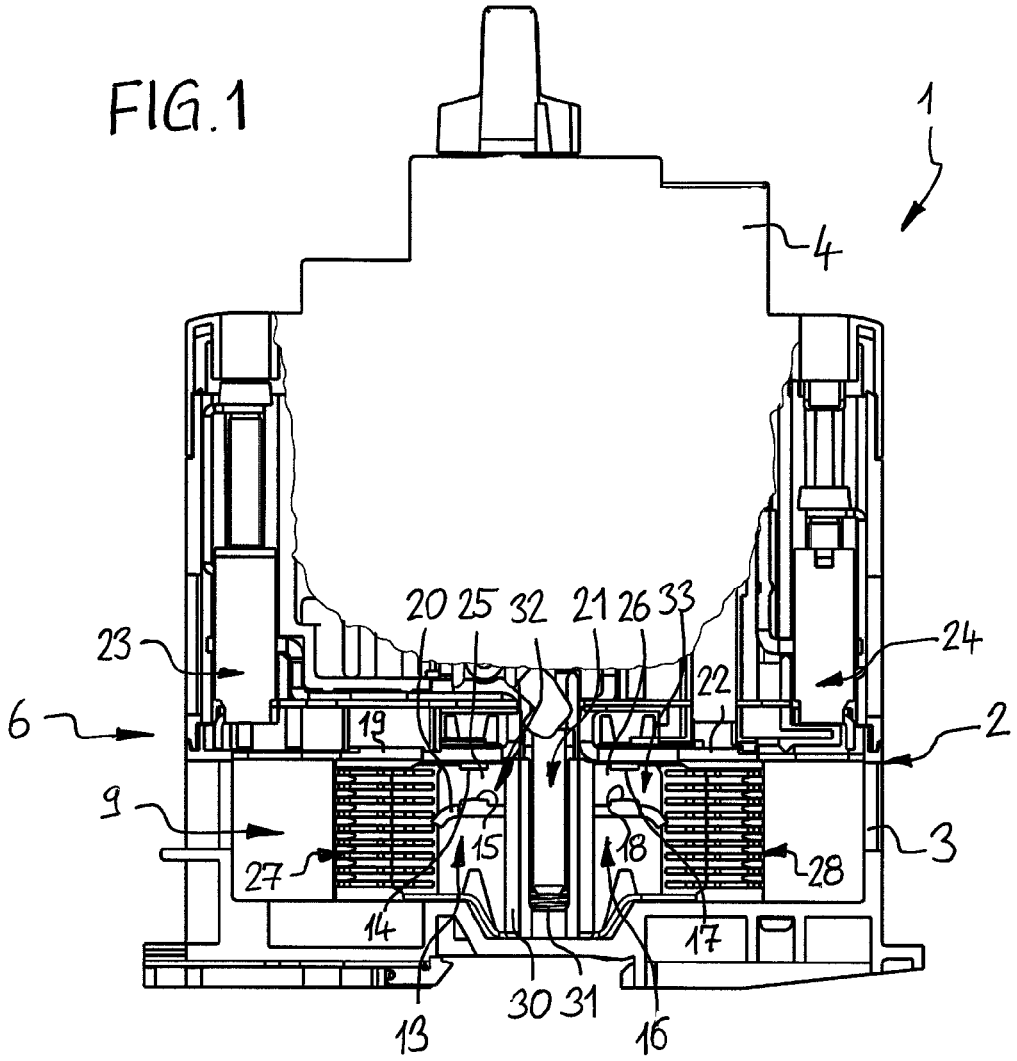
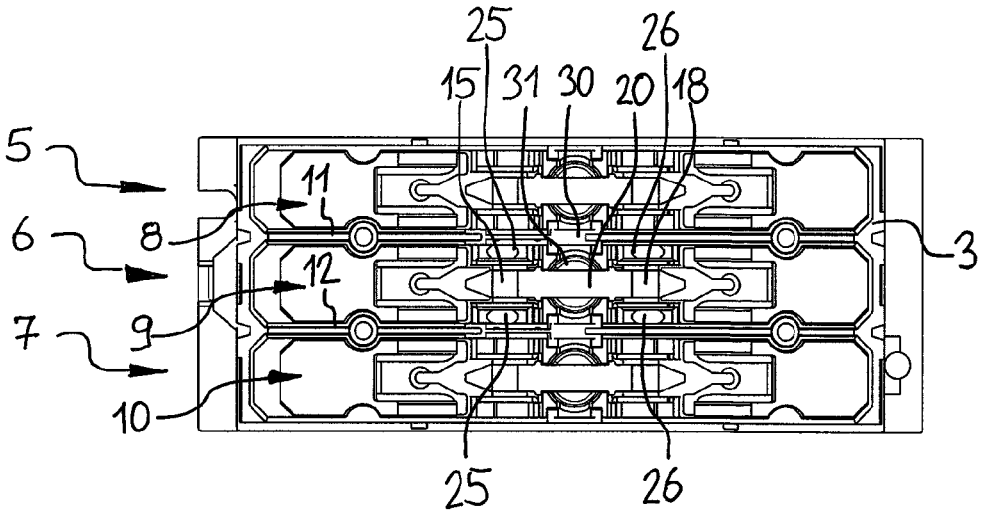
FIG.2

SWITCHING DEVICE FOR DIRECT CURRENT APPLICATIONS

CROSS-REFERENCE TO RELATED APPLICATIONS

This application is a U.S. National Stage Application under 35 U.S.C. §371 of International Application No. PCT/EP2012/071410 filed on Oct. 29, 2012, and claims benefit to European Patent Application No. EP 11191219.2 filed on Nov. 29, 2011. The International Application was published in German on Jun. 6, 2013, as WO 2013/079269 A1 under PCT Article 21(2).

FIELD

The invention relates to a switching device for direct current applications.

BACKGROUND

Such a switching device is known from EP2 061 053 A2. To create a switching device for direct current applications, it is recommended that the casing of a switching device for alternating current applications should be used, wherein additionally at least two permanent magnets are provided, which create a magnetic field with field lines predominantly transverse to the isolation gap in the current paths. There are three switching chambers in the casing for each single current path, wherein each current path is assigned a movable switching contact element as well as two fixed switching contact elements opposite to each other. The three moveable switching contact elements can be moved together, between a closed position which corresponds to the switched-on status of the switching device, and an open position which corresponds to the switched-off status of the switching device. The individual current paths are each assigned two arc extinguishing devices in the form of extinguishing plates, arranged individually over one another and electrically insulated from each other. In addition, each current path has two isolation gaps which are formed between the ends of the movable switching elements and the first and second fixed switching elements which are allotted to the ends of the movable switching contact elements when the movable switching contact elements are open. On opening of the switching contact elements, an arc which can be extinguished with the help of arc extinguishing devices is formed along each isolation gap. Since arcs in direct current applications cannot be extinguished during zero current passing as in alternating current applications, a magnetic field that drives the arc into an arc extinguishing device has to be used in direct current applications. The magnetic field created by the permanent magnets exerts a Lorenz force on the arc forming along the isolation gap and pushes it in the direction of the arc extinguishing devices. In the case of low voltages the arc is therefore safely extinguished in the arc extinguishing device. In the case of very high voltages however, there is the danger that the arc will flash onto one of the permanent magnets and set it on fire.

DE 34 09 564 A1 shows a similar switching device that has two switching chambers in each of which there is an arc extinguishing device and an arc driver arrangement.

SUMMARY

An aspect of the invention provides a switching device for direct current applications, the device comprising: a first switching chamber for a first current path; a second switching chamber for a second current path, wherein each current path includes a switching contact arrangement including a first contact and a second contact, wherein both contacts are configured to be in contact when the switching device is in switched-on status, wherein both contacts are configured to be held out of contact via an isolation gap when the switching device is in switched-off status, wherein each current path includes an extinguishing device configured to extinguish any arcs created between the first and second contacts, wherein solely in one of the at least one first switching chambers and second switching chamber, at least one arc driver arrangement is provided, and wherein, at least in an area of the switching contact arrangement for each current path, a magnetic field is created that drives an arc in the relevant extinguishing device.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 1 shows a partial longitudinal section of a switching device according to the invention; and FIG. 2 shows a top view of the switching device according to FIG. 1.

DETAILED DESCRIPTION

An aspect of the invention provides a switching device that can be used both for low voltage and for high voltage direct current applications.

An aspect of the invention provides a switching device comprising at least one first switching chamber for a first current path and a second switching chamber for a second current path, each current path having at least one switching contact arrangement that has a first contact and a second contact, wherein both contacts are in contact in a switched-on status of the switching device and in a switched-off status of the switching device they are out of contact with each other thereby forming an isolation gap, and each current path has at least one extinguishing device to quench any arcs that are created between the contacts.

An aspect of the invention provides a switching device for direct current applications which has at least a first switching chamber for a first current path and a second switching chamber for a second current path. Each current path is provided with at least one switching contact arrangement that has a first contact and a second contact, wherein both contacts are in contact when the switching device is in switched-on status and they are held out of contact via the creation of an isolation gap when the switching device is in switched-off status. Each current path is also provided with at least one extinguishing device to extinguish any arcs that occur between the contacts. For this an arc driver arrangement is provided which is arranged in one of the two switching chambers and creates a magnetic field at least in the area of the switching contact arrangement for each current path in order to drive the arc in the relevant extinguishing device.

Thus the switching device preferably has a switching chamber in which an arc driver arrangement is provided and a switching chamber in which no arc driver arrangement is provided. The switching device is therefore suitable for low voltages and also for high voltages. The switching chamber with the arc driver arrangement is suitable for low voltages where there is little danger of an arc flashing on the arc driver arrangement. In addition, the magnetic field for the arc driver arrangement is strong enough to quickly drive low voltage arcs into the extinguishing device. The switching chamber without the arc driver arrangement is particularly suitable for high voltages, since in this switching chamber there is no arc driver arrangement and so the arc cannot flash on such an arc driver arrangement. This guarantees that only minimal carbon deposits are formed by the burning of a permanent magnet or nearby casing walls, which would make extinguishing the arc more difficult. Depending on the geometry of the switching contact arrangement, the arc can already receive an independent impulse that drives it into the extinguishing device. On the other hand, both of the switching chambers of the switching device are arranged next to each other, so that the magnetic field of the arc driver arrangement also radiates on the switching chamber without the arc driver arrangement and creates a Lorenz force on any arcs that are created there. In this all the current paths are preferably arranged next to each other and parallel to one another. In particular, the switching chambers can also be divided from each other by partitions in the casing in the switching device, wherein the partitions are preferably made from an electrical insulation material that is magnetically permeable.

Depending on the application case, both current paths can be used, i.e. in the case of low voltages the current path is used with the arc driver arrangement and in the case of high voltages the current path is used without the arc driver arrangement. On the other hand the current paths can also be switched on electrically in parallel or in a row, so that in principle electricity flows through both current paths and, depending on the strength of the voltage and the resulting extinguishing behaviour based on this, one of the two current paths effects the extinguishing of an arc. The flow of electricity maintained by the arc is disrupted by this with the result that all the other arcs are extinguished.

In principle a third switching chamber can be provided for a third current path. If the arc driver arrangement is then arranged in the second switching chamber, this can be arranged between the first switching chamber and the second switching chamber. Thus the magnetic field of the arc driver arrangement for the second switching chamber radiates on both of the others, namely the first switching chamber and the third switching chamber. In principle it is however also conceivable that an arc driver arrangement is provided in the first switching chamber and the third switching chamber and that the second switching chamber, which is positioned between the first switching chamber and the third switching chamber, is not provided with an arc driver arrangement.

The arc driver arrangement can comprise two permanent magnets that are arranged on opposite sides of the switching contact arrangement and which create a magnetic field with field lines perpendicular to the isolation gap. In principle, the arc driver arrangement can comprise one permanent magnet that is arranged above the switching contact arrangement and which is arranged between two pole plates that are positioned laterally on the opposite sides of the switching contact arrangement.

Preferably every switching contact arrangement is provided with at least one arc steering arrangement, by means of which the arc is steered to the extinguishing device for the relevant switching contact arrangement. Such an arc steering arrangement usually comprises guide plates that run from the contacts in the direction of each of the extinguishing devices.

Each switching arrangement can in principle comprise one fixed contact and one moveable contact, wherein the first contact is arranged on a fixed contact carrier in the switching chamber and the second contact is arranged on a moveable bridge arrangement in the switching chamber. The bridge arrangement serves for the operation of the second contact.

In principle each current path can be provided with a double breaking system with two contact pairs, wherein each current path is provided with two contact arrangements and the two contacts are arranged on a moveable bridge contact piece, wherein the two contacts are electrically connected together via the bridge contact piece. Both contact pairs, each comprising a first contact and a second contact, are thus switched on in sequence. In this arcs are formed between each contact pair.

In principle the bridge contact pieces for all current paths can be operated by a joint bridge arrangement, so that by operating one element, namely the bridge arrangement, all the contact pairs and switching contact arrangements can be operated.

FIG. 1 shows the switching device 1 according to the invention in a partial longitudinal section with a casing 2, which comprises a lower part 3 and an upper part 4.

FIG. 2 shows a view of switching device 1, whereby the upper part 4 has been removed so that it is possible to look into the lower part 3. FIGS. 1 and 2 are presented jointly below.

Switching device 1 presents three poles, i.e. three switching paths, namely a first switching path 5, a second switching path 6 and a third switching path 7. Each switching path 5, 6, 7 is arranged in a separate switching chamber, namely a first switching chamber 8, a second switching chamber 9 and a third switching chamber 10. The switching chambers 8, 9, 10 are separated from each other electrically by partitions 11, 12 in the casing 2, wherein the partitions 11, 12 are preferably magnetically permeable. The three current paths 5, 6, 7 are identical with regard to their construction, wherein the construction of the current paths 5, 6, 7 are described in more detail in the following taking the middle, second current path 6 as an example.

The second current path 6 within the second switching chamber 9 is illustrated in longitudinal section in FIG. 1. The second current path 6 is double break constructed and shows a first switching contact arrangement 13 and a second switching contact arrangement 16. Both switching contact arrangements 13, 16 are identical and formed as mirror images of each other.

The first switching contact arrangement 13 which is illustrated in FIG. 1 on the left side, comprises a contact pair with a first contact 14 and a second contact 15. Correspondingly the second switching contact arrangement 16 is constructed with a second contact pair comprising a first contact 17 and a second contact 18.

The first contact 14 in the first switching contact arrangement 13 is arranged on a first fixed contact carrier 19. The first fixed contact carrier 19 is stationary and is therefore assigned as immobile in casing 2 of switching device 1. The first contact 17 is arranged at one first free end of the first fixed contact carrier 19. At one end not facing this end of the first fixed contact carrier 19 a first connection 23 for the connection of the first current path 5 in a direct current application is provided.

The second contact 15 of the first switching contact arrangement 13 is found on a bridge contact piece 20 of a bridge arrangement 21 and is arranged as moveable in casing 2. The bridge contact piece 20 can be vertically adjusted in the orientation illustrated in FIG. 1 to a raised or lowered position. In the raised position the second contact 15 in the first switching contact arrangement 13 comes into contact with the first contact 14. In the lowered position both the contacts 14, 15 are not in contact. In this position an isolation gap is created between the first contact 14 and the second contact 15, along which it is possible for an arc to form.

The second switching contact arrangement 16 is constructed identically to the first switching contact arrangement 13. The first contact 17 in the second switching contact arrangement 16 is positioned on a second fixed contact carrier 22 and is arranged on a first end of the second fixed contact carrier 22. At one end not facing this end of the second fixed contact carrier 22 a second connection 24 is provided.

The second contact 18 of the second switching contact arrangement 16 is also arranged on the bridge contact piece 20 and at one end of the second contact 15 of the first switching contact arrangement 13 not facing the latter. The bridge contact piece 20 is constructed to conduct electricity and connects both the contacts 15, 18 electrically to each other. In the raised position of the bridge contact piece 20 the second contact 18 of the second switching arrangement 16 is in contact with the first contact 17, wherein in the lowered position of the bridge contact piece 20 both contacts 17, 18 are kept out of contact and between these an isolation gap is created along which it is possible for an arc to form.

In the raised position of the bridge contact piece 20 a current can therefore flow from the first connection 23 via the first fixed contact carrier 19 to the first contact of the first switching contact arrangement 13, then further to the second contact 15 of the first switching contact arrangement 13 via the bridge contact piece 20 to the second contact 18 of the second switching contact arrangement 16. From there the current flows further to the first contact 17 of the second switching contact arrangement 16 via the second fixed contact carrier 22 to the second connection 24.

In order to adjust the bridge contact piece 20 a switch bridge 30 is provided, which is arranged vertically adjustable in casing 2 and moves the bridge contact piece 20. In the raised position of the bridge contact piece 20, which corresponds to the switched-on status of the switching device 1, the bridge contact piece 20 with its two contacts 15, 18 is pressed via a spring 31 against the first contacts 14, 17, wherein the spring 31 is supported between the bridge contact piece 20 and the switch bridge 30.

In the second switching chamber 9 two extinguishing devices, namely a first extinguishing device 27 and a second extinguishing device 28 are provided. The first extinguishing device 27 is assigned to the first switching contact arrangement 13 and the second extinguishing device 28 is assigned to the second switching contact arrangement 16. Both extinguishing devices 27, 28 are arranged on one of the opposite sides of the switch bridge arrangement 21 for the relevant switching contact arrangement 13, 16.

In order to drive arcs that are created between the contact pairs in the extinguishing devices 27, 28, two arc driver arrangements are provided in the second switching chamber 9, namely a first arc driver arrangement 32 and a second arc driver arrangement 33, wherein the first arc driver arrangement 32 is assigned to the first switching contact arrangement 13 and the second arc driver arrangement 33 is assigned to the second switching contact arrangement 16. The first arc driver arrangement 32 comprises two first permanent magnets 25, which are arranged in the second switching chamber 9 on the switching walls 11, 12 and which take up the first switching contact arrangement 13 between themselves, The first permanent magnets 25 are plate shaped and arranged parallel to the partitions 11, 12. Both first permanent magnets 25 are arranged with rectified magnetism so that an almost homogeneous magnetic field with field lines perpendicular to the separation direction is created between them. Thus the field lines of the magnetic field also run perpendicular to an arc that is created between the first contact 14 and the second contact 15 in the first switching contact arrangement 13. Lorenz force is thereby created by the magnetic field which influences the arcs and drives them in the direction of the first extinguishing device 27.

The second arc driver arrangement 33 is constructed in the same way as the first arc driver arrangement 32 and comprises two permanent magnets 26, which take up the second switching contact arrangement 16 between them. The magnetic field is thereby directed in the opposite direction to the magnetic field for the first permanent magnet 25. An arc that forms between the first contact 17 and the second contact 18 in the second switching contact arrangement 16, has a current direction that radiates spatially in the opposite direction to an arc between the contacts 14, 15 of the first switching contact arrangement 13. If an arc according to the illustration in FIG. 1 between the contacts 17, 18 in the second switching contact arrangement 16 has a current direction that flows vertically downwards, an arc between the contacts 14, 15 in the first switching contact arrangement shows a current direction that flows vertically upwards. In order to ensure the safe extinguishing of the arcs regardless of the direction of the current path, in the first current direction an arc in the first switching contact arrangement 13 must therefore be driven left into the first extinguishing device 27 and an arc in the second switching contact arrangement 16 to the right into the second extinguishing device 28. In order to achieve this the magnetic fields must be oriented in opposite directions.

The first current path 5 and the third current path 7 and the first switching chamber 8 and the third switching chamber 10 are identical to the second current path 6 and the second switching chamber 9, with the exception that in the first switching chamber 8 and the third switching chamber 10 no arc driver arrangements are provided. Therefore in the first switching chamber 8 and the third switching chamber 10 no permanent magnets are provided. The arc driver arrangements 32, 33 in the first current path 6 radiate onto the neighbouring switching chambers, namely the first switching chamber 8 and the third switching chamber 10, in order to be able to exert a Lorenz force on an arc created there as well.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

1 Switching device
2 Casing
3 Lower part
4 Upper part
5 First current path
6 Second current path
7 Third current path
8 First switching chamber
9 Second switching chamber
10 Third switching chamber
11 Partition
12 Partition
13 First switching contact arrangement
14 First contact
15 Second contact
16 Second switching contact arrangement
17 First contact
18 Second contact
19 First fixed contact carrier
20 Bridge contact piece
21 Bridge arrangement
22 Second fixed contact carrier
23 First connection
24 Second connection
25 First permanent magnets
26 Second permanent magnets
27 First extinguishing device
28 Second extinguishing device
29 Extinguishing plates
30 Switch bridge
31 Spring
32 First arc driver arrangement
33 Second arc driver arrangement

The invention claimed is:

1. A switching device for direct current applications, the device comprising:

a first switching chamber for a first current path, the first switching chamber having no arc driver arrangement; and a second switching chamber for a second current path, the second switching chamber having an arc driver arrangement disposed therein, wherein each current path includes a switching contact arrangement including a first contact and a second contact, wherein both contacts are configured to be in contact when the switching device is in switched-on status, wherein both contacts are configured to be held out of contact via an isolation gap when the switching device is in switched-off status, wherein each of the first and second current paths includes an extinguishing device configured to extinguish any arcs created between the first and second contacts of their respective current path, and wherein the arc driver arrangement of the second switching chamber is configured to create, at least in an area of the switching contact arrangement for each of the first and second current paths, a magnetic field that drives an arc into the extinguishing device of a respective current path.

2. The device of claim 1, wherein the first and second current paths are arranged next to each other and parallel to each other.

3. The device of claim 1, wherein the first and second switching chambers are divided from each other by partitions in a casing.

4. The device of claim 3, characterized that the partitions include electrical insulation material that is magnetically permeable.

5. The device of claim 1, wherein the first and second current paths are switched on either in parallel or in a row.

6. The device of claim 1, further comprising:

a third switching chamber for a third current path.

7. The device of claim 6, wherein the second switching chamber is arranged between the first switching chamber and the third switching chamber.

8. The device of claim 1, wherein the arc driver arrangement includes two permanent magnets, wherein the two permanent magnets are arranged on opposite sides of the switching contact arrangement of the second switching chamber, and wherein the two permanent magnets create a magnetic field with field lines perpendicular to the isolation gap of at least the first current path or the second current path.

9. The device of claim 1, wherein at least one of the switching contact arrangements includes an arc steering arrangement configured to steer the arc to the extinguishing device of the switching contact arrangement including the arc steering arrangement.

10. The device of claim 1, wherein first contacts in each of the switching contact arrangements are each arranged on a fixed contact carrier in a respective switching chamber, and wherein second contacts in each of the switching contact arrangements are each arranged on a moveable bridge arrangement in a respective switching chamber.

11. The device of claim 1, wherein each current path includes two contact arrangements, wherein two second contacts are arranged on a moveable bridge contact piece, and wherein the two second contacts are electrically connected to each other via the bridge contact piece.

12. The device of claim 11, wherein the bridge contact pieces for all current paths can be operated by a joint bridge arrangement.

13. The device of claim 11, wherein the bridge contact pieces for all current paths are configured to be operated by a joint bridge arrangement.

14. The device of claim 8, wherein the two permanent magnets of the arc driver arrangement are disposed within the second switching chamber.

* * * * *